US011035139B2

(12) United States Patent
Huang et al.

(10) Patent No.: US 11,035,139 B2
(45) Date of Patent: Jun. 15, 2021

(54) ABOVE GROUND POOL ASSEMBLY

(71) Applicant: BESTWAY INFLATABLES & MATERIAL CORP., Shanghai (CN)

(72) Inventors: Shuiyong Huang, Shanghai (CN); Xiaobo Chen, Shanghai (CN); Chun Yang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 41 days.

(21) Appl. No.: 16/672,298

(22) Filed: Nov. 1, 2019

(65) Prior Publication Data

US 2020/0141143 A1 May 7, 2020

(30) Foreign Application Priority Data

Nov. 2, 2018 (CN) ..... 201821797266.3

(51) Int. Cl.
*E04H 4/00* (2006.01)

(52) U.S. Cl.
CPC ..... *E04H 4/005* (2013.01)

(58) Field of Classification Search
CPC . E04H 4/005; E04H 4/0056; E04H 2004/146; E04H 2004/068; B05D 5/08;
(Continued)

(56) References Cited

U.S. PATENT DOCUMENTS 1,817,774 A * 8/1931 Sipe ..... F16L 17/04 285/231
3,033,468 A * 5/1962 Lewis ..... B05D 1/34 239/215
(Continued)

FOREIGN PATENT DOCUMENTS

CN 205777703 U * 12/2016 ..... E04H 4/0056
DE 19904335 8/1999
EP 3255226 12/2017

OTHER PUBLICATIONS

How to make and measure surface textures for plastics injection molding (https://www.plasticstoday.com/injection-molding/how-make-and-measure-surface-textures-plastics-injection-molding) Aug. 15, 2018 (Year: 2018).*
(Continued)

*Primary Examiner* — Benjamin R Shaw
(74) *Attorney, Agent, or Firm* — Dickinson Wright PLLC

(57) ABSTRACT

An above ground pool assembly comprises a bracket and a pool body. The bracket includes a plurality of horizontal and vertical support members. The horizontal support members couple to one another forming an upper frame. The plurality of vertical support members couple to the upper frame. The pool body has a side wall, wherein a top of the side wall is provided with a plurality of sleeves. The sleeves attach to the plurality of horizontal support members. Each horizontal support member has an outer surface with an uneven texture. The uneven texture reduces the contact areas between the pool body and the horizontal support members and avoids adhesion between the pool body and the horizontal support members, so that the pool body and the bracket can be separated easily, thereby reducing the possibility of damaging the pool body. Moreover, the wear resistance and slip resistance of the bracket are improved.

18 Claims, 6 Drawing Sheets

(58) Field of Classification Search
CPC ..... A47H 1/02; E06C 7/081; F16L 58/1072; F16L 58/02; Y10S 138/11
USPC ..... 4/506
See application file for complete search history.

(56) References Cited

U.S. PATENT DOCUMENTS 4,356,933 A * 11/1982 Connolly ..... B65D 88/16 220/495.08
5,083,327 A * 1/1992 Gillebaard ..... E04H 4/0056 4/506
5,592,702 A * 1/1997 Gillebaard, Jr. ..... E04H 4/0056 4/506
6,561,372 B1 * 5/2003 Connolly ..... B65D 90/205 220/9.1
2002/0042947 A1 * 4/2002 Chang ..... E04H 4/0056 4/506
2002/0042948 A1 * 4/2002 Lee ..... E04H 4/0056 4/506
2009/0144892 A1 * 6/2009 Brindle ..... E04H 4/0025 4/506
2009/0205121 A1 * 8/2009 Cheng ..... E04H 4/0056 4/506
2015/0231667 A1 * 8/2015 Krawczyk ..... B05D 3/0254 138/145
2015/0315804 A1 * 11/2015 Liu ..... E04H 4/0018 4/506
2016/0201348 A1 * 7/2016 Liu ..... E04H 4/0056 4/506
2016/0215513 A1 * 7/2016 Liu ..... E04H 4/0056
2016/0222686 A1 * 8/2016 Liu ..... E04H 4/0056
2017/0009475 A1 1/2017 Liu
2017/0089085 A1 * 3/2017 Liu ..... E04H 4/0056
2017/0356206 A1 * 12/2017 Huang ..... E04H 4/0056
2019/0301184 A1 * 10/2019 Huang ..... E04H 4/0056
2020/0149570 A1 * 5/2020 Huang ..... E04H 4/0056

OTHER PUBLICATIONS

CN205777703—english tranlation, machine generated Jan. 2021. (Year: 2021).*
Extended European Search Report dated Mar. 16, 2020 (Mar. 16, 2020) by the Euorpean Patent Office on related European patent application 19206019.2.

* cited by examiner

ABOVE GROUND POOL ASSEMBLY

CROSS REFERENCE TO RELATED APPLICATION

This application claims priority to Chinese Application Serial Number CN201821797266.3, filed on Nov. 2, 2018, the entire disclosure of which is incorporated herein by reference.

RELATED FIELD

The present invention generally relates to a pool assembly and, more specifically, to an above ground pool assembly.

BACKGROUND

An above ground pool is a recreational product that can be installed in an outdoor open area. For example, an above ground pool can be installed in a yard or in other open areas of a home for adults and children to play. An above group pool is very popular because it is easy to install and has good use.

There are various forms of above ground pools. For example, a circular bracket pool is one common above ground pool. The circular bracket pool mainly includes a plurality of horizontal support tubes, a plurality of vertical support tubes, and a pool body made of flexible reinforced PVC sheeting. The pool body includes a vertical pool wall and a pool bottom, and the pool wall is mounted to the horizontal support tubes.

The plurality of horizontal support tubes connect to the plurality of vertical support tubes as a support structure for the bracket pool. The pool wall of the pool body is located inside the vertical support tubes. The pool wall connects to an edge of the pool bottom and extends vertically upward. A reinforcing belt, having a continuous circular shape, is located inside the vertical support tubes and outside of the pool wall. The reinforcing belt covers the whole or a part of the circumference of the pool body and is connected with the pool wall. A fixing belt, having a continuous circular shape, is disposed outside the reinforcing belt and the vertical support tubes. At least one fixing device is attached to the reinforcing belt wherein the fixing belt passes through the fixing device.

Oftentimes, an above ground pool is installed in an outdoor open area and is used during the summer when the weather is hot. Accordingly, an above ground pool can be subjected to sun exposure for long periods. The horizontal and vertical support tubes of the above ground pools are generally made from steel, and, under sun exposure, the temperature of the steel tubes increases. Similarly, the temperature of the PVC sheet of the pool body also increases. As a result, sticky ingredients in the PVC sheet may be released thereby causing the PVC sheet to adhere to the surface of the steel tubes. This creates difficulties in separating the pool body from the support tubes during the process of disassembling the above ground pool. If the pool body is forcibly separated from the support tubes, it can easily damage the pool body.

SUMMARY

Embodiments of the present invention overcome the deficiencies mentioned above and solve the problem of the PVC sheet being adhered to the bracket of the above ground pool assembly. Embodiments of the present invention provide an above ground pool assembly that allows easy removal of the pool body from the bracket of the above ground pool assembly. In addition, the embodiments of the present invention provide an above ground pool assembly having improved wear resistance and slip resistance of the bracket.

Embodiments of the present invention provide an above ground pool assembly including a bracket and a pool body. The bracket includes a plurality of horizontal support members and a plurality of vertical support members. The plurality of horizontal support members are coupled to one another forming an upper frame. The plurality of vertical support members are coupled to the upper frame for supporting the upper frame. The pool body has a side wall, wherein a top of the side wall is provided with a plurality of sleeves. The plurality of sleeves attach to the plurality of horizontal support members. Each horizontal support member of the plurality of horizontal support members has an outer surface with an uneven texture.

By providing an uneven texture on the surface of the horizontal support members of the bracket of the above ground pool assembly, it reduces the contact area between the pool body and the horizontal support members. In addition, it avoids the adhesion between the pool body and the horizontal support members so that the pool body and the bracket can be separated easily. Accordingly, the pool body cannot be easily damaged during separation. In addition, the inclusion of the uneven texture improves wear resistance and slip resistance of the bracket.

BRIEF DESCRIPTION OF THE DRAWINGS

Other advantages of the embodiments of present invention will be readily appreciated, as same becomes better understood by reference to the following detailed description when considered in connection with the accompanying drawings wherein.

DESCRIPTION OF THE ENABLING EMBODIMENT

The exemplary embodiments of the present invention will be described in detail with reference to the accompanying drawings herein. It should be understood that the description herein for the exemplary embodiments should be considered as illustrative of the structure of the inflatable product, and is not intended to limit the present invention to the exemplary embodiments.

In the present disclosure, the terms "upper", "lower", "left", "right", etc. are used for the convenience of description and are not restrictive. Moreover, "horizontal" and "vertical" herein are merely for convenience of description and are not restrictive.

Figure 1:
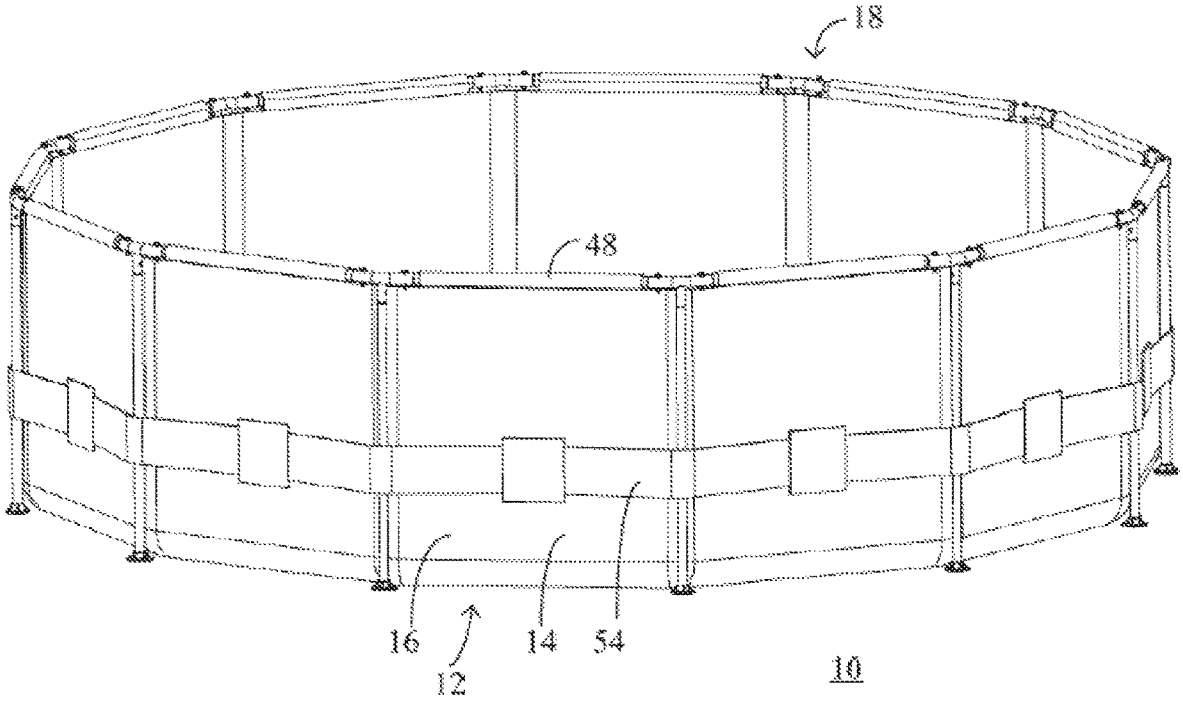
FIG. 1 is a perspective view of an above ground pool assembly constructed in accordance with an embodiment of the present invention.

Referring to the Figures, wherein like numerals indicate corresponding parts throughout the several views, an above ground pool assembly 10 constructed in accordance with an embodiment of the present invention is generally shown in FIG. 1.

As best illustrated in FIG. 1, the above ground pool assembly 10 includes a pool body 12. The pool body 12 is configured to contain water in which adults and children play. It should be understood that the function of the above ground pool assembly 10 is not limited to the entertainment function for people to play in water, as it can also be used for other purposes. The pool body 12 includes a bottom wall (not shown) and a side wall 14. In the illustrated embodiment, the bottom wall of the pool body 12 is substantially planar and can be placed on a flat surface. The side wall 14 of the pool body 12 extends substantially vertically from a top to a bottom. The side wall 14 of the pool body 12 attaches to the bottom wall via an arcuate transition portion having a generally circular shape. In the illustrated embodiment, the side wall 14 of the pool body 12 is formed by splicing together a plurality of side sheets 16.

According to an embodiment of the present invention, the pool body 12 can be mainly made from a PVC (Polyvinyl Chloride) material and a tarpaulin material. The tarpaulin material generally includes two layers of PVC material and a base fabric sandwiched between two layers of PVC material.

Figure 2:
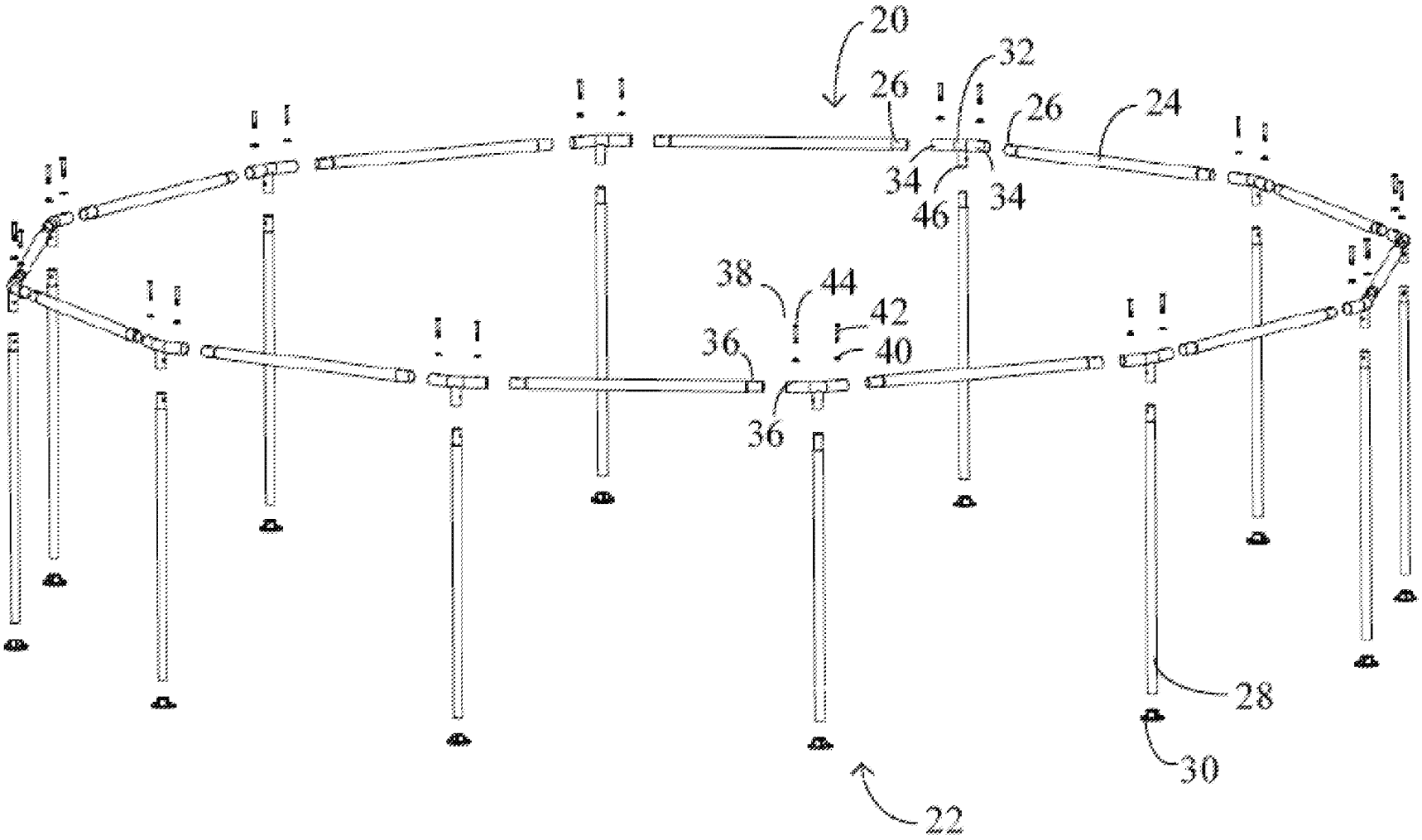
FIG. 2 is an exploded view of a bracket of the above ground pool assembly constructed in accordance with an embodiment of the present invention.

The above ground pool assembly 10 further includes a bracket 18 for providing support to the pool body 12. FIG. 2 shows an exploded perspective view of the bracket 18 of the above ground pool assembly 10. As best shown in FIGS. 1 and 2, the bracket 18 includes a plurality of horizontal support members 24 and a plurality of vertical support members 28. The plurality of horizontal support members 24 are coupled to one another forming an upper frame 20. The plurality of vertical support members 28 are coupled to the upper frame 20 for providing support to the upper frame 20.

According to one embodiment of the present invention, the plurality of horizontal support members 24 are sequentially arranged to form the upper frame 20 having a generally circular shape. Each of the plurality of horizontal support members 24 extends between two ends 26 wherein adjacent ends 26 of two adjacent horizontal support members 24 of the plurality of horizontal support members 24 are coupled to each other, thereby forming the upper frame 20.

In the exemplary embodiment shown in FIGS. 1 and 2, each of the plurality of horizontal support members 24 is a straight tube. The upper frame 20, formed by the plurality of horizontal support members 24 connected to one another, has a generally circular shape. It should be understood that the horizontal support member 24 may be curved. In addition, it should be understood that the upper frame 20 can have shapes other than the circular shape illustrated in FIGS. 1 and 2. For example, a standard circular shaped upper frame can be formed using a plurality of horizontal support members wherein each of the horizontal support members is a curved tube. Alternatively, an elliptical shaped upper frame can be formed using a plurality of horizontal support members in the form of curved tubes having different curvatures. According to another embodiment of the present invention, square or rectangular shaped upper frames can be formed using a plurality of horizontal support members in the form of straight tubes. Additionally, in some embodiments, some of the plurality of horizontal support members for forming the upper frame are straight tubes and some are curved tubes. Accordingly, the horizontal support members can be connected to each other to form an oblong shaped upper frame. It should be understood that the upper frame may also be integrally formed. For example, the upper frame can be an integrally formed circular horizontal support member.

The plurality of vertical support members 28 are sequentially arranged, circumferentially spaced apart from one another, wherein one end of each of the plurality of the vertical support members 28 is connected to the upper frame 20 to provide support to the upper frame 20.

According to one embodiment of the present invention, each vertical support member 28 of the plurality of vertical support members 28 is a straight tube extending between an upper end and a lower end. The upper end of each of the vertical support members 28 is connected to the upper frame 20. The lower end of each of the vertical support members 28 is supported on the ground. In the illustrated embodiment, the lower end of each vertical support member 28 is also connected to a base 30 wherein the contact area of the base 30 with the ground is larger, so that the vertical support member 28 can be more stably supported on the ground.

According to one embodiment of the present invention, the above ground pool assembly 10 can further includes a plurality of connectors 32. Each connector 32 of the plurality of connectors 32 is disposed between two adjacent horizontal support members 24 of the plurality of horizontal support members 24. Adjacent ends 26 of two adjacent horizontal support members 24 of the plurality of horizontal support members 24 are respectively connected to the connector 32.

Each of the plurality of connectors 32, having a generally T-shape, includes two horizontal tubes 34. The adjacent ends 26 of two adjacent horizontal support members 24 of the plurality of horizontal support members 24 are respectively inserted into the horizontal tubes 34 of a connector 32. It should be understood that it is also possible for the two horizontal tubes 34 of the connector 32 to be inserted into the adjacent ends 26 of two adjacent horizontal support members 24, respectively. In the illustrated embodiment of the present invention, the connection of the end 26 of the horizontal support member 24 to the connector 32 is a detachable connection. The horizontal tube 34 and the end 26 of the horizontal support member 24 are each provided with a through hole 36. A pin 38 is inserted into the through holes 36 of the horizontal tube 34 and the end 26 of the horizontal support member 24 such that the horizontal tube 34 connects to the end 26 of the horizontal support member 24. It should be understood that the horizontal support member 24 can be separated from the connector 32 by pulling the pin 38 out of the through holes 36 of the horizontal tube 34 and the end of the horizontal support member 24 when the bracket 18 is disassembled.

Referring to FIG. 2, the bracket 18 of the above ground pool assembly 10 includes a waterproof ring 40. The pin 38 includes a stem portion 42 and a head portion 44. The stem portion 42 of the pin 38 is inserted into the waterproof ring 40 and the through holes 36 of the horizontal tube 34 and the end 26 of the horizontal support member 24. The waterproof ring 40 is located between the head portion 44 of the pin 38, and the horizontal tube 34 and end 26 of the horizontal support member 24. By providing the waterproof ring 40, it is possible to prevent rainwater or water in the pool body 12 from flowing into the horizontal tube 34 and the horizontal support member 24 through the through holes 36 of the horizontal tube 34 of the connector 32 and the end 26 of the horizontal support member 24.

The upper end of each of the plurality of vertical support members 28 connects to the connector 32. The connector 32 includes a vertical tube 46 for receiving the upper end of the vertical support member 28. It should be understood that it is also possible for the vertical tube 46 of the connector 32 to be inserted into the upper end of the vertical support member 28. In the illustrated embodiment, the connection of the end of the vertical support member 28 to the connector 32 is a detachable connection.

The structure of the bracket 18 of the above ground pool assembly 10 has been described above. The bracket 18 of the above ground pool assembly 10 is supported on the ground. The disassembly and assembly of the bracket 18 of the above ground pool assembly 10 is facilitated by providing the plurality of horizontal support members 24, the plurality of vertical support members 28, and the connectors 32.

A top of the side wall 14 of the pool body 12 is provided with a sleeve 48, and the sleeve 48 is coupled to the upper frame 20. More specifically, the top of the side wall 14 of the pool body 12 is provided with a plurality of sleeves 48, and each sleeve 48 of plurality of sleeves 48 is coupled to the corresponding horizontal support member 24. In the illustrated embodiment, each sleeve 48 of the pool body 12 is disposed on the top of each side sheets 16 forming the side wall 14 of the pool body 12. Thus, the pool body 12 is mounted on the bracket 18, and the pool body 12 is also supported as the bracket 18 is supported by the ground to form the above ground pool assembly 10.

Figure 3:
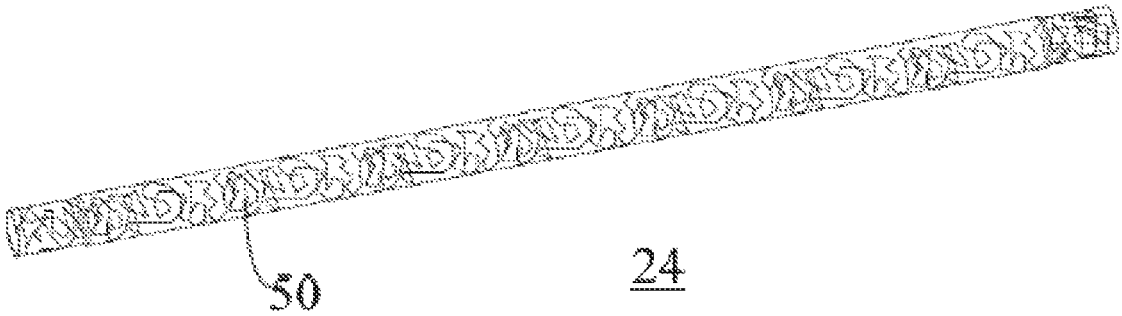
FIG. 3 is a perspective view of a horizontal support member of a bracket of the above ground pool assembly constructed in accordance with an embodiment of the present invention.
Figure 4:
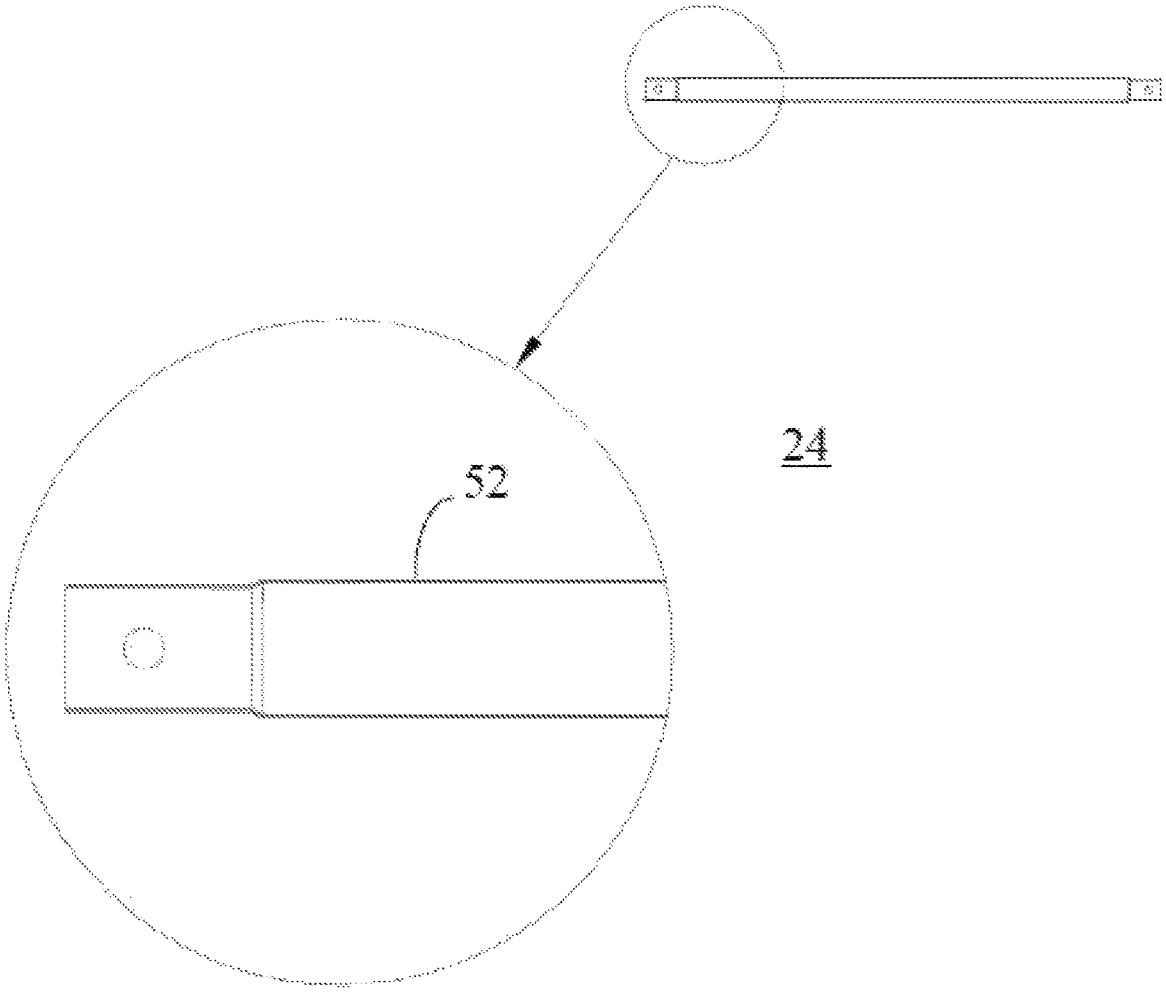
FIG. 4 is an enlarged sectional view of the horizontal support member of a bracket of the above ground pool assembly in accordance with an embodiment of the present invention.

FIGS. 3 and 4 respectively show a perspective view and, an enlarged sectional view (as well as a partial enlarged sectional view) of a horizontal support member 24 of the above ground pool assembly 10 according to one embodiment of the present invention. Each horizontal support member 24 of the plurality of horizontal support members 24 has an outer surface provided with an uneven texture.

Figure 5:
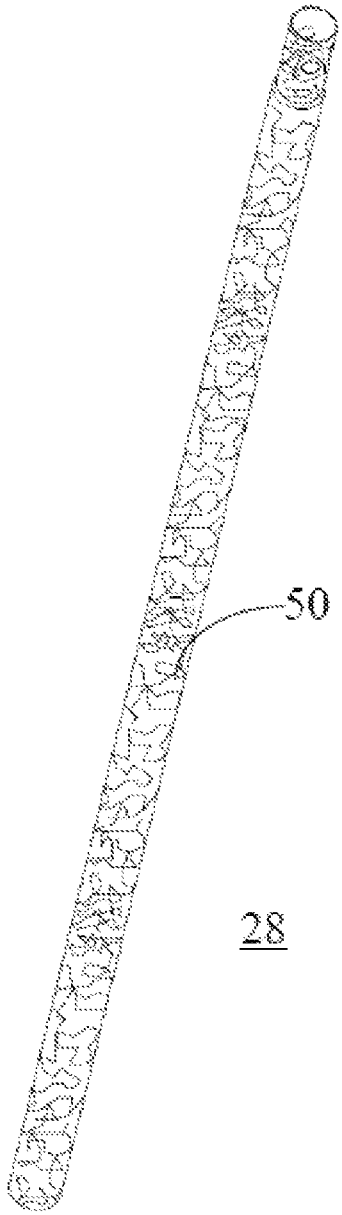
FIG. 5 is a perspective view of a vertical support member of a bracket of the above ground pool assembly constructed in accordance with an embodiment of the present invention.

In one embodiment of the present invention, the horizontal support member 24 is made from metal. As shown in FIG. 4, an outer surface of the metal is coated with a coating 52 which forms an uneven texture 50, as shown in FIG. 5. In particular, the outer surface of the metal is at least partially covered by the coating 52 to form a plurality of lines protruding from the metal to establish the uneven texture 50. The coating 52 can form an uneven texture 50 by selecting a suitable sprayer and coating material. By forming the uneven texture 50 on the outer surface of the metal, the contact area between the sleeve 48 of the side wall 14 of the pool body 12 and the horizontal support member 24 can be reduced. Thus, adhesion between the sleeve 48 of the side wall 14 of the pool body 12 and the horizontal support member 24 can be avoided, so that separation of the pool body 12 from the bracket 18 becomes easier, and no damage to the pool body 12 due to such separation, thereby extending the service life of the pool body 12. According other embodiments of the present invention, the coating 52 can also contain materials that are suitable for preventing rust and/or emitting fluorescence.

As illustrated in FIG. 3, according to one embodiment of the present invention, the plurality of lines are in an irregular pattern forming the uneven texture 50. The use of the uneven texture 50 makes the coating process simpler and the manufacturing processes more convenient.

According to another embodiment of the present invention, the horizontal support member 24 is an injection-molded tube. An outer surface of the injection-molded tube forms the uneven texture 50. Specifically, the uneven texture 50 can be formed on the outer surface of the injection-molded tube by using a suitable injection molding machine.

FIG. 5 shows a perspective view of a vertical support member 28 of the above ground pool assembly 10 constructed in accordance with an embodiment of the present invention. An outer surface of each of the plurality of vertical support members 28 is at least partially formed by a coating that includes a plurality of lines to establish the uneven texture 50. Referring back to FIG. 1, the outer surface of the side wall 14 of the pool body 12 is in contact with the vertical support members 28. When the pool body 12 contains water, the outer surface of the side wall 14 of the pool body 12 abuts against the vertical support members 28 due to the force of the water against the side wall 14. Moreover, the above ground pool assembly 10 includes a fixing belt 54 that sandwiches the vertical support members 28 between the fixing belt 54 and the side wall 14 of the pool body 12 to stabilize the connection between the pool body 12 and the bracket 18. The fixing belt 54 is also in contact with or even abuts against the vertical support members 28. By providing the uneven texture 50 on the surface of the vertical support members 28, the contact areas of the side wall 14 of the pool body 12 and the fixing belt 54 with the vertical support tubes 28 can be reduced. Accordingly, adhesion between the side wall 14 of the pool body 12 and the fixing belt 54 with the vertical support tubes 28 can be avoided, so that separation of the pool body 12 from the bracket 18 becomes easier, and no damage to the pool body 12 due to such separation thereby extending the service life of the pool body 12.

Figure 6:
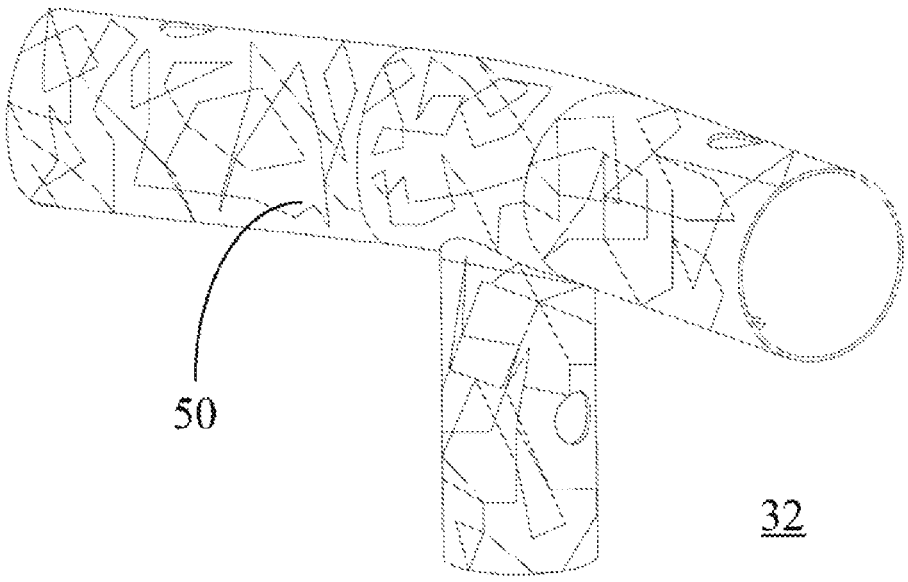
FIG. 6 is a perspective view of a connection joint of a bracket of the above ground pool assembly constructed in accordance with an embodiment of the present invention.

FIG. 6 provides a perspective view of a connector 32 of the above ground pool assembly 10 according to an embodiment of the present invention. An outer surface of the connector 32 is provided with an uneven texture 50. Thereby, the visual effect of the bracket 18 as a whole is more uniform.

In accordance with the description above, it should be appreciated that, by providing an uneven texture 50 on the surfaces of the horizontal support members 24 of the bracket 18 of the above ground pool assembly 10, it reduces the contact area between the pool body 12 and the horizontal support members 24. In addition, it avoids adhesion between the pool body 12 and the horizontal support members 24 so that the pool body 12 and the bracket 18 can be separated easily. Accordingly, the pool body 12 cannot be easily damaged during separation. In addition, the inclusion of the uneven texture 50 improves wear resistance and slip resistance of the bracket 18. The visual contrast between the bracket 18 and the pool body 12 is small, and the overall visual effect of the above ground pool assembly 10 is improved. Anti-rust and fluorescing functions can be achieved by adding rust-preventing and fluorescence-emitting materials to the coating 52. By providing the plurality of horizontal support members 24, the plurality of vertical support members 28 and the connectors 32, the disassembly and assembly of the bracket 18 of the above ground pool assembly 10 becomes more convenient.

Obviously, many modifications and variations to embodiments of the present invention are possible in light of the above teachings and may be practiced otherwise than as specifically described while within the scope of the claimed invention. It is understood that all features described of all embodiments of the present invention can be combined with each other, so long as such combination would not contradict one another.

What is claimed is:

1. An above ground pool assembly, comprising:

a bracket comprising an upper frame comprising a plurality of horizontal support members coupled to one another, and a plurality of vertical support members coupled to said upper frame; and a pool body comprising a side wall, a top of said side wall comprising a plurality of sleeves attached to said plurality of horizontal support members;

wherein each horizontal support member of said plurality of horizontal support members is made from metal, and an outer surface of said metal is at least partially covered by a coating that forms a plurality of lines protruding from said metal, thereby forming an uneven texture.

2. The above ground pool assembly as set forth in claim 1, wherein said plurality of lines are in an irregular pattern.

3. The above ground pool assembly as set forth in claim 1, wherein said coating comprises at least one of anti-rust elements and fluorescence-emitting elements.

4. The above ground pool assembly as set forth in claim 1, wherein each vertical support member of said plurality of vertical support members has an outer surface with an uneven texture.

5. The above ground pool assembly as set forth in claim 4, wherein said outer surface of each of said plurality of vertical support members is at least partially formed by a coating that forms a plurality of lines to establish said uneven texture.

6. The above ground pool assembly as set forth in claim 5, wherein said plurality of lines are in an irregular pattern.

7. The above ground pool assembly as set forth in claim 1, further including a plurality of connectors, with each connector of said plurality of connectors being disposed between adjacent horizontal support members of said plurality of horizontal support members, coupling said plurality of horizontal support members to one another forming said upper frame;

wherein each connector of said plurality connectors has an outer surface with an uneven texture.

8. The above ground pool assembly as set forth in claim 1, wherein said the pool body is made from a PVC material or a tarpaulin material.

9. The above ground pool assembly as set forth in claim 1, wherein said upper frame has a substantially circular shape.

10. The above ground pool assembly as set forth in claim 1, wherein each horizontal support member of said plurality of horizontal support members has two ends with adjacent ends of each pair of adjacent horizontal support members of said plurality of horizontal support members being coupled to each other forming said upper frame.

11. The above ground pool assembly as set forth in claim 1, wherein each horizontal support member of said plurality of horizontal support members is one of a straight tube and an arcuate-shaped tube.

12. The above ground pool assembly as set forth in claim 1, wherein one end of each vertical support member of said the plurality of vertical support members is coupled to said upper frame.

13. The above ground pool assembly as set forth in claim 12, wherein another end of each vertical support member of said the plurality of vertical support members is coupled to a base.

14. The above ground pool assembly as set forth in claim 1, further comprising a plurality of connectors, with each connector of said plurality of connectors being disposed between adjacent horizontal support members of said plurality of horizontal support members, coupling said plurality of horizontal support members to one another forming said upper frame.

15. The above ground pool assembly as set forth in claim 14, wherein said plurality of vertical support members are circumferentially spaced apart from one another with one end of each vertical support member of said plurality of vertical support members being coupled to a corresponding connector of said plurality of connectors.

16. The above ground pool assembly as set forth in claim 14, wherein said each connector of said plurality of connectors has a T-shape and includes a pair of horizontal tubes for receiving adjacent ends of two adjacent horizontal support members of said plurality of horizontal support members.

17. The above ground pool assembly as set forth in claim 16, wherein each horizontal tube of said pair of horizontal tubes and each end of said adjacent ends define a through hole for receiving a pin coupling a corresponding horizontal support member to a corresponding connector.

18. The above ground pool assembly as set forth in claim 17, wherein said pin includes a stem portion and a head portion, wherein said bracket includes a waterproof ring and wherein said stem portion of said pin is inserted into said waterproof ring and through said through hole, whereby said waterproof ring is located between said head portion and a corresponding horizontal tube.

* * * * *